US006279915B1

(12) United States Patent
Grimm et al.

(10) Patent No.: US 6,279,915 B1
(45) Date of Patent: Aug. 28, 2001

(54) REFRACTORY CHANNEL WITH OUTER INSULATION AND METHOD FOR JOINT PACKING

(75) Inventors: Daniel Grimm, Schwalbach; Raimund Brückner, Niedernhausen; Jivan Kapoor, Wiesbaden; Robert Hellermann, Siegen, all of (DE)

(73) Assignee: Didier-Werke AG, Wiesbaden (DE)

( * ) Notice: Subject to any disclaimer, the term of this patent is extended or adjusted under 35 U.S.C. 154(b) by 0 days.

(21) Appl. No.: 09/301,588

(22) Filed: Apr. 29, 1999

(30) Foreign Application Priority Data

Apr. 29, 1998 (DE) ..... 198 19 114

(51) Int. Cl.[7] ..... F16J 15/14

(52) U.S. Cl. ..... 277/590; 277/412; 222/591

(58) Field of Search ..... 277/590, 412, 277/413, 418, 421; 165/9, DIG. 26; 222/591

(56) References Cited

U.S. PATENT DOCUMENTS 4,037,762 * 7/1977 Ruckstuhl .
4,268,015 5/1981 Lührsen et al. .
4,327,847 * 5/1982 Tinnes .
4,429,816 * 2/1984 Thrower .
4,573,616 * 3/1986 Shapland .
4,627,481 * 12/1986 Keisers et al. .
4,724,985 * 2/1988 Dessar .
4,776,502 10/1988 Hagenburger et al. .
4,854,487 * 8/1989 Ando et al. .
5,106,106 * 4/1992 Bruckner et al. .
5,186,886 * 2/1993 Zerinvary et al. .
5,335,896 * 8/1994 Idstein et al. .

FOREIGN PATENT DOCUMENTS 28 07 123 8/1979 (DE) .
3420835 12/1985 (DE) .
196 51 534 2/1998 (DE) .
0 503 237 9/1992 (EP) .
0 822 022 2/1998 (EP) .
WO 98/05452 * 2/1998 (WO) .

* cited by examiner

*Primary Examiner*—B. Dayoan
*Assistant Examiner*—William L. Miller
(74) *Attorney, Agent, or Firm*—Wenderoth, Lind & Ponack, L.L.P.

(57) ABSTRACT

A tubular refractory channel (2) that can be inserted as a flowthrough for liquid metal into a thermally insulating outer lining (10) and can be connected with the outer lining (10) by a refractory mortar layer (9). In order to prevent liquid metal from penetrating into the mortar layer (9), even if the mortar layer contracts, the outer lining (10) overlaps the metal inflow-side of a front face (4) of the channel (2).

19 Claims, 1 Drawing Sheet

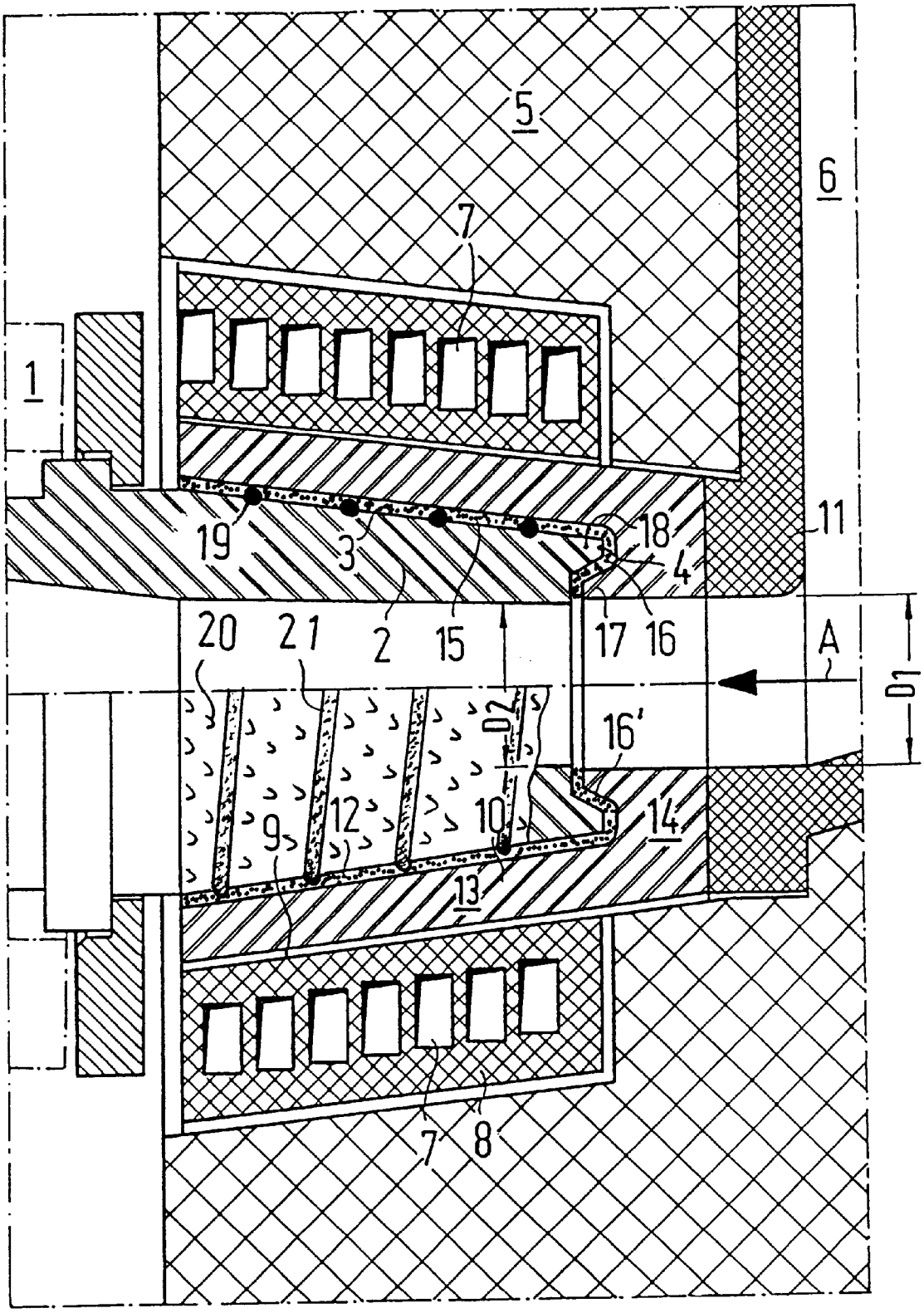
5
6
7
1
19
3
18
11
4
20
21
2
15
17
16
A
D1
D2
16'
12
10
14
9
13
7
8

REFRACTORY CHANNEL WITH OUTER INSULATION AND METHOD FOR JOINT PACKING

BACKGROUND OF THE INVENTION

1. Field of the Invention

The present invention relates to a tubular refractory channel, in particular a refractory nozzle, serving as a flowthrough for liquid metals, in particular liquid steel, with the channel being insertable into a thermally insulating outer lining and the channel and the outer lining being, if appropriate, connectable with a refractory mortar layer.

The invention relates furthermore to a method for packing joints between two refractory parts, in particular rotationally symmetrical parts, disposed one within the other which can be connected with a refractory mortar or cement, against the penetration of liquid metal, in particular liquid steel.

2. Description of Related Art

DE 196 51 534 A1 describes such a device. A refractory pouring sleeve as a wear part is slid into an insulating intermediate sleeve. A cement layer is provided in the joint between the sleeves. The pouring sleeve is heated inductively to casting temperatures. Thereby the cement layer is also brought nearly to casting temperatures. The result can be contraction, which leads to the fact that after a certain degree of wear, liquid metal can enter the space between the sleeves. This is undesirable. In particular, in the case of inductive heating of the pouring sleeves, liquid metal itself which has penetrated into the joint becomes coupled to the electromagnetic field of the inductor whereby it is additionally heated and liquified so that the danger exists that the cemented joint is under strong corrosive stress, wears prematurely and, consequently, further liquid metal can penetrate into the joint. Furthermore, the danger exists of a breakthrough of liquid metal at the other end of the joint. The liquid metal that has penetrated into the joint, incidentally, shields at least partially the pouring sleeve against the electromagnetic field of the inductor such that its intended heating is impaired.

SUMMARY OF THE INVENTION

It is the task of the present invention to propose a channel and a joint packing of the above described type in which liquid metal is prevented from penetrating into the joint.

The above object is achieved according to the invention by constructing the thermally insulating outer lining so that it overlaps the front face at the metal inflow-side of the tubular channel in the axial and radial direction so that the front face, on the one hand, is protected and, on the other hand, the joint between channel and outer lining, which can be filled with a refractory mortar, is not accessible in the aural direction of the main flow of the liquid metal such that no significant quantities of the liquid metal can penetrate into the joint.

In a preferred embodiment of the invention, the joint between the channel and the outer lining in the region of the front face of the channel is at least singly bent at an angle in the manner of a labyrinth in the approximately radial and approximately axial direction of the channel. This lengthens the joint and makes the penetration of liquid metal difficult in particular if it is filled with mortar or cement since the liquid metal would have to enter into the joint against the direction of the main flow, which is not to be anticipated.

In a preferred embodiment of the invention, a refractory cord and/or a refractory textile tape is wound around the channel. The mortar volume in the joint becomes smaller corresponding to the volume of the cord and/or the textile tape such that the contraction of the mortar has a lesser effect. A material can be used for the cord and/or the textile tape, which contracts significantly less than mortar and, unlike mortar, does not become hard and brittle by sintering but rather retains a certain elasticity by fissuring throughout. The cord and/or the textile tape preferably comprises substantially carbon.

A method of the above-described type is distinguished thereby in that onto the outer diameter of a second refractory part (channel) slidable into a first refractory part (outer lining) an encircling refractory cord or an encircling refractory textile tape is applied and that subsequently the two parts are slid one above the other in a mortar and/or cement bed potentially placed between them such that the first refractory part overlaps, as a thermally insulating outer lining at the side at which the metal flows in, the front face of the second refractory part (channel).

Therewith a simple method is created with which the joint is packed such that even if the mortar or cement contracts, virtually no liquid metal penetrates into it.

Further advantageous embodiments of the invention are evident in the appended claims and the following description of an exemplary embodiment.

BRIEF DESCRIPTION OF THE DRAWING

The FIGURE depicts in partial section a melt vessel connected to a chill mold.

DETAILED DESCRIPTION OF THE INVENTION

A chill mold 1 includes a sleeve in the form of a tubular, rotationally symmetrical, refractory channel 2 which comprises a material capable of being inductively coupled. The channel 2 has a conical outer surface 3 and a front face 4 at the inflow side of the channel 2.

An inductor 7 is installed in a wall 5 of a metallurgical melt vessel 6 (tundish). The inductor 7 is supported in a sleeve brick 8. An outer lining 10, formed by a rotationally symmetrical, refractory formed part is fastened in the sleeve brick 8 by means of mortar layer 9. The outer lining is external with respect to the channel 2. The outer surface 3 of the channel 2 and the outer lining 10 are formed so as to have a conical shape in order to facilitate sliding one into the other. The melt vessel 6 is lined on the inside with a wear layer 11 that also overlaps the outer lining 10 at the inflow side of the channel 2.

Between the outer lining 10 and the channel 2 is a joint 12. The outer lining 10 forms a region 13 that encompasses the outer surface 3 of channel 2, and a region 14 that overlaps the front face 4 of channel 2. Consequently, the joint 12 forms a zone 15 between the region 13 and the outer surface 3 and a zone 16 between the region 14 and the front face 4. Zone 16 is thus bent at an angle in an approximately radial direction and an approximately axial direction, and thus, the zone 16 is in the form of a labyrinth. The zone is moved out of the main effective region of the inductor 7.

In the region 14 of the outer lining 10, overlapping front face 4, there is an annular projection 17 directed in the main flow direction A of the melt. On the front face 4 of channel 2 there is an annular projection 18 extending in a direction opposite or against the main flow direction A. Also, the projection 18 is disposed radially outside of the projection 17 with respect to the throughlet cross section. Thereby, the joint 12 is bent at an angle in zone 16 in the form of a labyrinth, with one labyrinth course 16' in the proximity of the throughflow cross section being directed against the direction of the main flow A.

During operation the liquid metal flows in the main flow direction A from the melt vessel 6 into the chill mold 1. The throughflow cross section D1 for the metal melt in region 14 of the outer lining 10 is approximately equal to that of the throughflow cross section D2 in the main flow direction A of the channel 2 in the proximity of the front face 4. As shown in the FIGURE, the throughflow cross section D1 is slightly larger than the throughflow cross section D2. The throughflow cross section D2 of channel 2 can expand toward the chill mold 1.

A mortar and/or cement layer can be provided in joint 12, and such layer, which additionally serves for packing joint 12. The joint 12 may also preferably be provided with not only mortar or cement, but a refractory cord 21 and/or a refractory textile tape, preferably substantially comprising carbon.

As shown in the FIGURE, the refractory cord and/or the refractory textile tape can be wound spirally or helically on the outer surface 3 and, potentially, additionally on the front face 4 of channel 2. In order to improve the seating and retention of the cord and/or the textile tape on the outer surface 3 or the front face 4, prefabricated grooves 19, extending spirally or helically, can be formed on the outer surface 3 and/or on the front face 4. Instead of the grooves, or in addition, the outer surface 3 and/or the front face 4 can also be roughened as indicated by reference numeral 20.

In order to carry out simply the desired packing of the joint 12, the cord and/or the textile tape is wound onto the exposed outer surface 3 of channel 2 and potentially the front face 4 before the melt vessel 6 is moved to the chill mold 1. Subsequently a mortar and/or cement bed is placed on the outer surface 3 and/or into the outer lining fastened on the melt vessel 6. Subsequently the melt vessel 6 with the outer lining 10 is slid over channel 2 of the chill mold 1. Thereby, region 14 of the outer lining 10 then overlaps the front face 4.

However, it is also possible to connect the outer lining 10 and the channel 2 directly with one another if, based on their production and during their connection, the two refractory parts can be joined with narrow tolerances.

If during a subsequent operation the melt flows from the melt vessel 6 in the main flow direction A through the throughflow cross sections D1 and D2 into the chill mold 1, when the inductor 7 is switched on, no significant quantities of melt will penetrate into joint 12, especially in zone 15. The penetration of melt into zone 15 is prevented due to the overlap of the front face 4 and the resulting labyrinth form, as well as potentially the mortar or cement layer and the cord or the textile tape, respectively.

What is claimed is:

1. An outlet structure for liquid metals, said outlet structure comprising:

a tubular refractory channel having a front face at an inflow-side of said tubular refractory channel;

an inductor disposed outwardly of said tubular refractory channel; and a thermally insulating outer lining positioned along an outer wall of said tubular refractory channel and overlapping the front face of said tubular channel, said outer lining being disposed between said inductor and said tubular refractory channel, wherein said outer lining and said tubular refractory channel are connectable by a refractory mortar or a cement layer.

2. An outlet structure as claimed in claim 1, wherein said tubular refractory channel comprises a refractory sleeve.

3. An outlet structure as claimed in claim 1, wherein a joint is defined between said tubular refractory channel and said outer lining, and the portion of the joint located in a region of the front face is angled outwardly with respect to a longitudinal axis of said tubular refractory channel.

4. An outlet structure as claimed in claim 1, wherein a joint is defined between said tubular refractory channel and said outer lining, and the portion of the joint located in a region of the front face defines a labyrinth.

5. An outlet structure as claimed in claim 1, wherein a refractory material is wound around said tubular refractory channel.

6. An outlet structure as claimed in claim 5, wherein said refractory material comprises refractory cord and refractory textile tape.

7. An outlet structure as claimed in claim 6, wherein said tubular refractory channel has a conical outer configuration, and said refractory cord and said refractory textile tape are wound spirally around said tubular refractory channel.

8. An outlet structure as claimed in claim 7, wherein said tubular refractory channel is formed with grooves or a roughened surface.

9. An outlet structure as claimed in claim 8, wherein said grooves are spiral grooves.

10. An outlet structure as claimed in claim 6, wherein the refractory material covers the front face of said tubular refractory channel.

11. An outlet structure as claimed in claim 5, wherein said refractory material comprises refractory cord or refractory textile tape.

12. An outlet structure as claimed in claim 11, wherein said tubular refractory channel has a conical outer configuration, and said refractory cord or said refractory textile tape is wound spirally around said tubular refractory channel.

13. An outlet structure as claimed in claim 11, wherein said refractory cord and said refractory textile tape are comprised substantially of carbon.

14. An outlet structure as claimed in claim 11, wherein said tubular refractory channel is formed with grooves or a roughened surface.

15. An outlet structure as claimed in claim 14, wherein said grooves are spiral grooves.

16. An outlet structure as claimed in claim 1, wherein said front face of said tubular refractory channel defines an outer annular projection, and an overlapping portion of said outer lining forms an inner annular projection.

17. An outlet structure as claimed in claim 16, wherein a joint is defined between said tubular refractory channel and said outer lining, and opposing faces of said outer and inner projections define a portion of said joint that is angled outwardly with respect to a longitudinal axis of said tubular refractory channel in a direction opposing a direction of flow through said tubular refractory channel.

18. A method of packing joints between first and second refractory parts to inhibit penetration of liquid metal into the joints, the method comprising:

applying a refractory tape or a refractory cord around the second refractory part; and inserting the second refractory part into the first refractory part such that a joint is formed therebetween and an inflow-side front face of said second refractory part is overlapped by said first refractory part, wherein the first refractory part forms a thermally insulating outer lining.

19. A method of packing joints as claimed in claim 18, further comprising applying a refractory mortar or cement to one of the first and second refractory parts before the second refractory part is inserted in the first refractory part.

* * * * *